US007850019B2

(12) United States Patent
Muth

(10) Patent No.: US 7,850,019 B2
(45) Date of Patent: Dec. 14, 2010

(54) KEG STACKING DEVICE

(76) Inventor: James T. Muth, 3159 W. Southland Dr., Franklin, WI (US) 53132

( * ) Notice: Subject to any disclaimer, the term of this patent is extended or adjusted under 35 U.S.C. 154(b) by 821 days.

(21) Appl. No.: 11/689,802

(22) Filed: Mar. 22, 2007

(65) Prior Publication Data

US 2008/0230427 A1 Sep. 25, 2008

(51) Int. Cl.
*A47G 29/00* (2006.01)

(52) U.S. Cl. ..... 211/85.22

(58) Field of Classification Search ..... 211/85.22, 211/13.1, 4, 74, 85.18, 85.19; 206/499, 335, 206/445; 220/23.83
See application file for complete search history.

(56) References Cited

U.S. PATENT DOCUMENTS 2,616,568 A * 11/1952 Bundgus ..... 211/74
3,261,380 A * 7/1966 Holleman ..... 141/106
3,749,414 A * 7/1973 Lynn ..... 280/47.19
3,809,258 A * 5/1974 Shepherd ..... 206/391
3,907,117 A * 9/1975 Williams ..... 211/85.19
3,913,778 A * 10/1975 Oglesbee ..... 220/23.83
4,217,941 A * 8/1980 Catalano ..... 141/372
4,331,244 A * 5/1982 Davis, Jr. ..... 211/194
4,431,107 A * 2/1984 Bergstrom et al. ..... 211/59.4
4,625,780 A * 12/1986 Burnham ..... 141/319
4,679,695 A * 7/1987 Leff ..... 211/85.21
4,998,629 A * 3/1991 Cheng ..... 211/85.18
5,012,938 A * 5/1991 King ..... 211/191
5,090,587 A * 2/1992 Brown ..... 220/475
5,111,944 A * 5/1992 Ostermeyer ..... 211/133.1
5,149,041 A * 9/1992 Hartke ..... 248/146
5,417,329 A * 5/1995 Whitman ..... 206/499
5,887,718 A * 3/1999 Oslin et al. ..... 206/499
5,964,260 A * 10/1999 Chudy ..... 141/319
D431,971 S * 10/2000 Hatton ..... D7/619.1
6,290,074 B1 * 9/2001 Syvuk et al. ..... 211/74
6,536,612 B2 * 3/2003 Flores ..... 211/85.22
6,637,607 B2 * 10/2003 Tombu ..... 211/85.22
6,745,802 B2 * 6/2004 Varga ..... 141/319
6,851,563 B1 * 2/2005 Lipari ..... 211/74
7,044,311 B2 * 5/2006 Flores Flores ..... 211/85.22
7,398,889 B1 * 7/2008 McNulty ..... 211/77
7,494,308 B2 * 2/2009 Chun ..... 410/47
2002/0036178 A1 * 3/2002 Tombu ..... 211/74
2002/0043509 A1 * 4/2002 Lajeunesse et al. ..... 211/59.2
2002/0066844 A1 * 6/2002 Kelly ..... 248/312.1
2004/0040923 A1 * 3/2004 Wolff ..... 211/194

(Continued)

*Primary Examiner*—Sarah Purol
(74) *Attorney, Agent, or Firm*—Absolute Technology Law Group LLC

(57) ABSTRACT

A substantially cube-shaped device for safely stacking one keg on top of another comprised of three groups of bars, each of the first group of bars being substantially parallel to each other and perpendicular to the other groups of bars, each of the second group of bars being substantially parallel to each other and perpendicular to the other groups of bars, and each of the third group of bars being substantially parallel to each other and perpendicular to the other groups of bars and a plurality of locking members, each locking member positioned at a meeting point of one bar from each of the three groups. The kegs can be used to store and/or transport any liquid, and can further include a rubber coating or pad to prevent damaging the device and/or the kegs. The device can also further include additional support members.

18 Claims, 4 Drawing Sheets

U.S. PATENT DOCUMENTS

2005/0230586 A1* 10/2005 Gary ..... 248/311.2
2006/0081549 A1* 4/2006 Gracia Lecina ..... 211/85.22
2007/0068888 A1* 3/2007 Tombu ..... 211/85.22
2008/0006596 A1* 1/2008 Palmeri ..... 211/189
2008/0023425 A1* 1/2008 Ricciardi ..... 211/126.2

* cited by examiner

KEG STACKING DEVICE

FIELD OF THE INVENTION

This invention relates generally to the field of storing and stacking fluid containers, and in particular to the field of a device to aid in the safe storage and stacking of beer kegs and the like.

BACKGROUND

Figure 1:
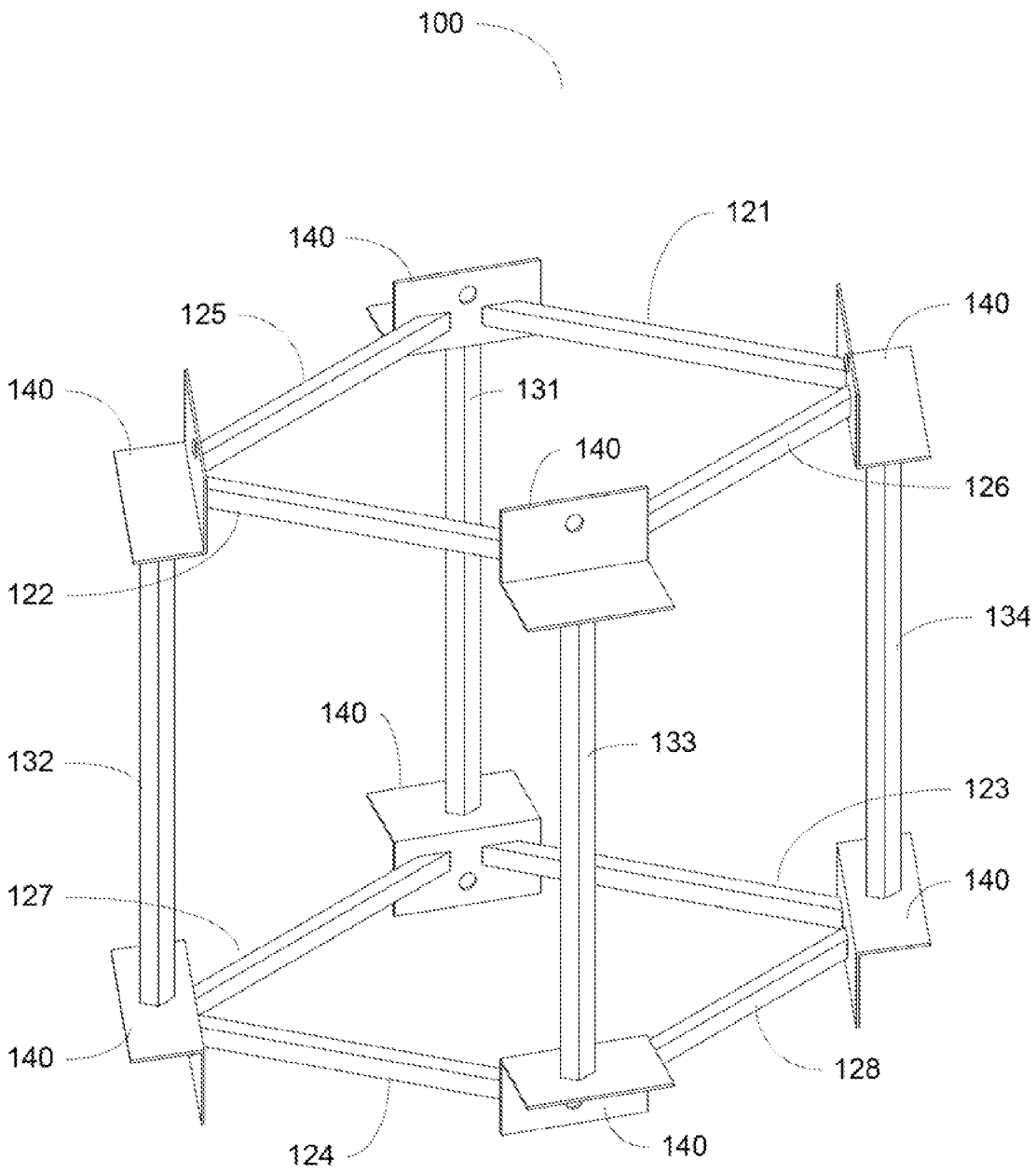
FIG. 1 shows a top perspective view of one embodiment of the keg stacking device.

The beverage industry often utilizes reusable and refillable cylindrical containers to hold, and oftentimes dispense, its contents. One example of such a containers is the beer keg, which is often filled with new contents at the site of the bottling or brewing company, loaded onto trucks, and taken to their retail destination. Empty and returned kegs are also retrieved and returned to the beverage company for cleaning and refilling.

Kegs, regardless of the material from which they are made, are often heavy, especially when filled. As such, it is convenient, if not necessary, that the containers be stacked on top of one another to allow the greatest number of containers to be safely stored in the smallest amount of space, whether in transporting the containers, storing the containers at the generation point, or holding the containers at the retail destination. To that end, the keg stacking device allows for the safe stacking of keg containers and the like without having to modify the kegs.

As used herein, "keg" refers to any generally cylindrically-shaped container or vessel for storing and/or shipping water and other liquids, including beer as well as other assorted beverages and fluids such as chemicals, paints, and the like, including combinations thereof. Such kegs can be made of any material commonly used in the art, including metal, resin, carbon fiber and plastic.

DETAILED DESCRIPTION OF EMBODIMENTS OF THE INVENTION

For the purpose of promoting an understanding of the present invention, references are made in the text hereof to embodiments of a keg stacking device, only some of which are depicted in the figures. It should nevertheless be understood that no limitations on the scope of the invention are thereby intended. One of ordinary skill in the art will readily appreciate that modifications such as the size and shape of the components, materials from which the components are made, the container to be safely stacked, and the inclusion of additional elements are deemed readily apparent and obvious to one of ordinary skill in the art, and all equivalent relationships to those illustrated in the drawings and described in the written description do not depart from the spirit and scope of the present invention. Some of these possible modifications are mentioned in the following description. Therefore, specific details disclosed herein are not to be interpreted as limiting, but rather as a basis for the claims and as a representative basis for teaching one of ordinary skill in the art to employ the present invention in virtually any appropriately detailed system, structure, or manner.

It should be understood that the drawings are not necessary to scale, emphasis instead being placed upon illustrating the principles of the invention. In addition, in the embodiments depicted herein, like reference numerals refer to like structural elements in the various drawings.

Moreover, the term "substantially" or "approximately" as used herein my be applied to modify any quantitative representation that could permissibly vary without resulting in a change in the basic function to which it is related. For example, on embodiment of a keg stacking device is disclosed herein as being cubic, i.e., each side of the device has roughly the same dimensions. The keg stacking device permissibly be somewhat non-cubic and still be within the scope of the invention if its functionality is not materially altered.

Referring now to the drawings, FIG. 1 shows a top perspective view of one embodiment of keg stacking device 100. In the embodiment shown, keg stacking device 100 is comprised of horizontal bars 121, 122, 123, 124, 125, 126, 127, and 128, vertical bars 131, 132, 133, and 134, and locking members 140. Horizontal bars 121, 122, 123, and 124 are each parallel to one another. Horizontal bars 125, 126, 127, and 128 are also each parallel to one another. And vertical bars are all positioned 131, 132, 133, and 134. Horizontal bars 121, 122, 123, 124, 125, 126, 127, and 128 and vertical bars 131, 132, 133, and 134 meet at locking members 140 (described in detailed infra) at right angle, forming a substantially cubic structure. Horizontal bars 121, 122, 123, 124, 125, 126, 127, and 128, vertical bars 131, 132, 133, and 134, and locking members 140 are joined using MIG welding. However, it should be understood that any other means can be employed, including but not limited to TIG welding, arc welding, interlocking members, adhesives, and constructing keg stacking device 100 as a single integrated unit.

In the embodiment shown in FIG. 1, horizontal bars 121, 122, 123, 124, 125, 126, 127, and 128, vertical bars 131, 132, 133, and 134, and locking members 140 are all made of mid steel. However, it should be understood that any alternate material having sufficient strength and durability to support a keg (not shown) can be used, including by not limited to aluminum, high density plastic, resin, carbon fiber, and composites or combinations thereof.

Figure 2:
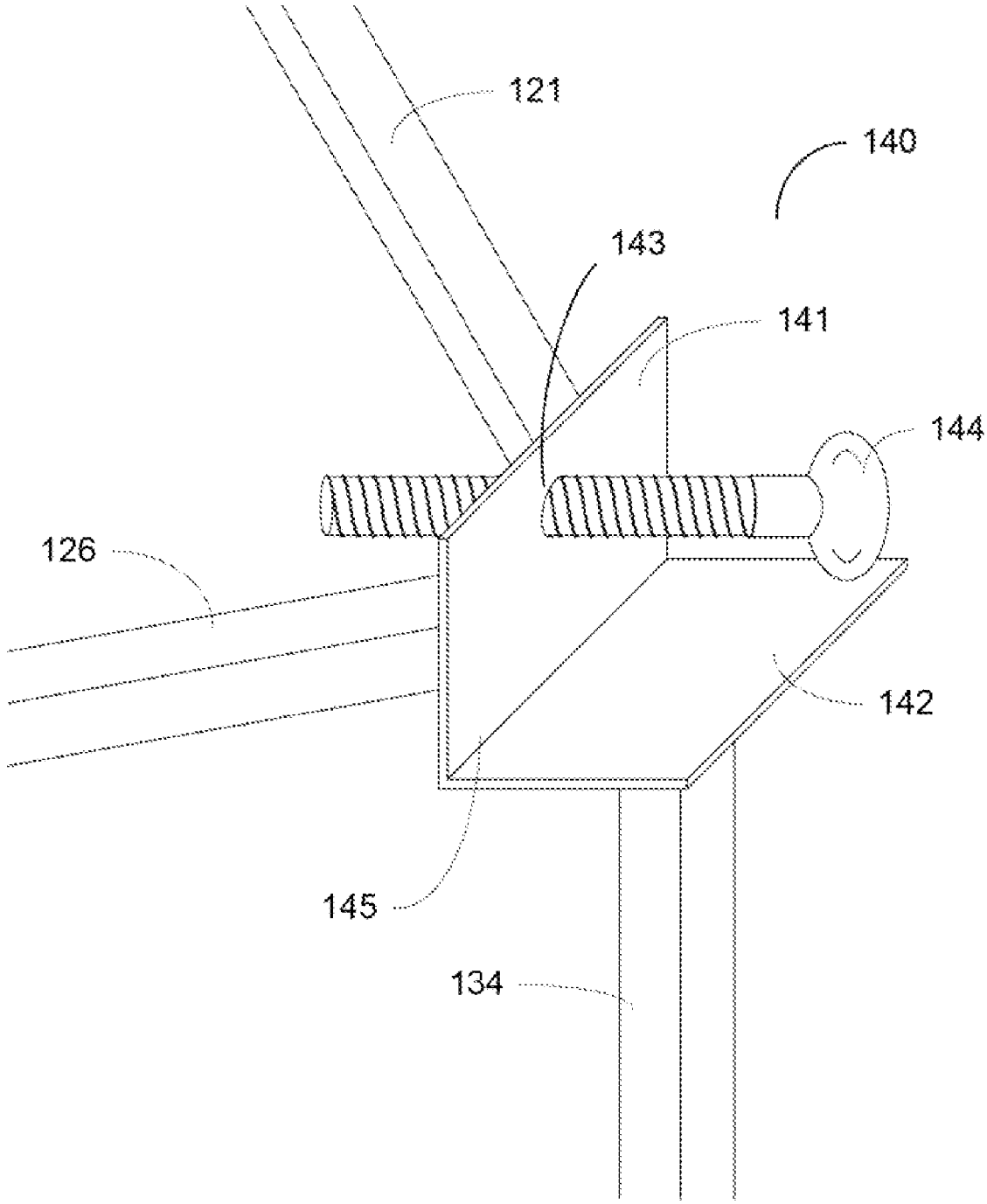
FIG. 2 shows a top perspective view of one embodiment of a locking member used in the embodiment of the keg stacking device shown in FIG. 1.

FIG. 2 shows a top perspective view of one embodiment of locking member 140 used in the embodiment of keg stacking device 100 shown in FIG. 1. The particular locking member 140 shown in FIG. 2 is at the meeting point of horizontal bars 121, 126 and vertical bar 134. Locking member 140 is comprised of vertical portion 141, horizontal portion 142 (collectively making up a locking member base), aperture 143, and adjustable keg engaging member 144. Horizontal bars 121, 126 are welded (as provided supra) to vertical portion 141, and vertical bar 134 is welded to the underside of horizontal portion 142. Horizontal portion 141 and vertical portion 142 are made of one (1) component and bent at 145, but could alternatively be made of two (2) separate pieces welded or otherwise connected. Vertical portion 141 is further comprised of aperture 143 through which adjustable keg engaging member 144 is positioned. Adjustable keg engaging member 144 has threads disposed thereon, allowing the lateral position of adjustable keg engaging member 144 to be changed, thus allowing each adjustable keg engaging member 144 to be secured to the keg (shown and described infra with respect to FIG. 3). In the embodiment shown, adjustable keg engaging member 144 is a thumb screw, but alternate embodiments of adjustable keg engaging member 144 can be any type of screw that allows its position to be laterally altered, including but not limited to license plate bolts and a threaded eye bolt. In addition, one of ordinary skill in the art will recognize that another type of locking member 140 can be employed with keg stacking device 100 as long as it is sufficiently strong, compatible with the materials of the other components, and temporarily locks the keg in position.

Figure 3:
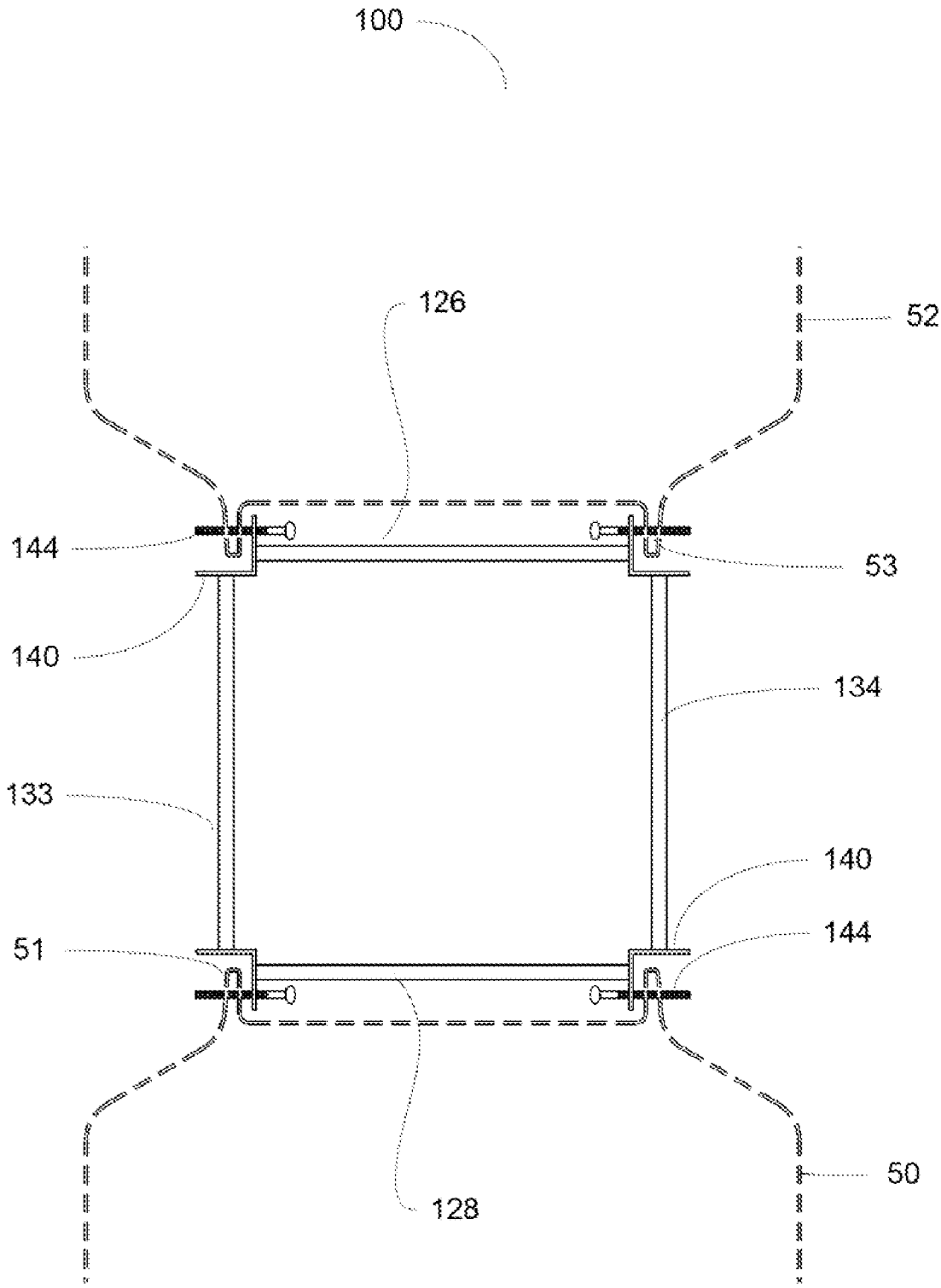
FIG. 3 shows a cross-sectional side view of the embodiment of the keg stacking device shown in FIG. 1 in use with two kegs.

FIG. 3 shows a cross-sectional side view of the embodiment of keg stacking device 100 shown in FIG. 1 in use with two (2) kegs 50, 52, both shown in broken lines. Keg 50 includes neck 51, and keg 52 includes neck 53. As can be appreciated keg stacking device 100 engaging neck 51 on one (1) end and neck 53 on a second end. Each thumb screw 144 is tightened until its forward end extends laterally a sufficient length to engage neck 51, 53. Keg stacking device 100 thus allows keg 52 to be safely and stably placed on top of keg 50. It should be understood that the embodiment of locking members 140 shown in FIG. 3 are only one (1) embodiment. Alternate types of locking members that temporarily lock kegs 50, 52 in place relative to keg stacking device 100 and one another can also be used.

Figure 4:
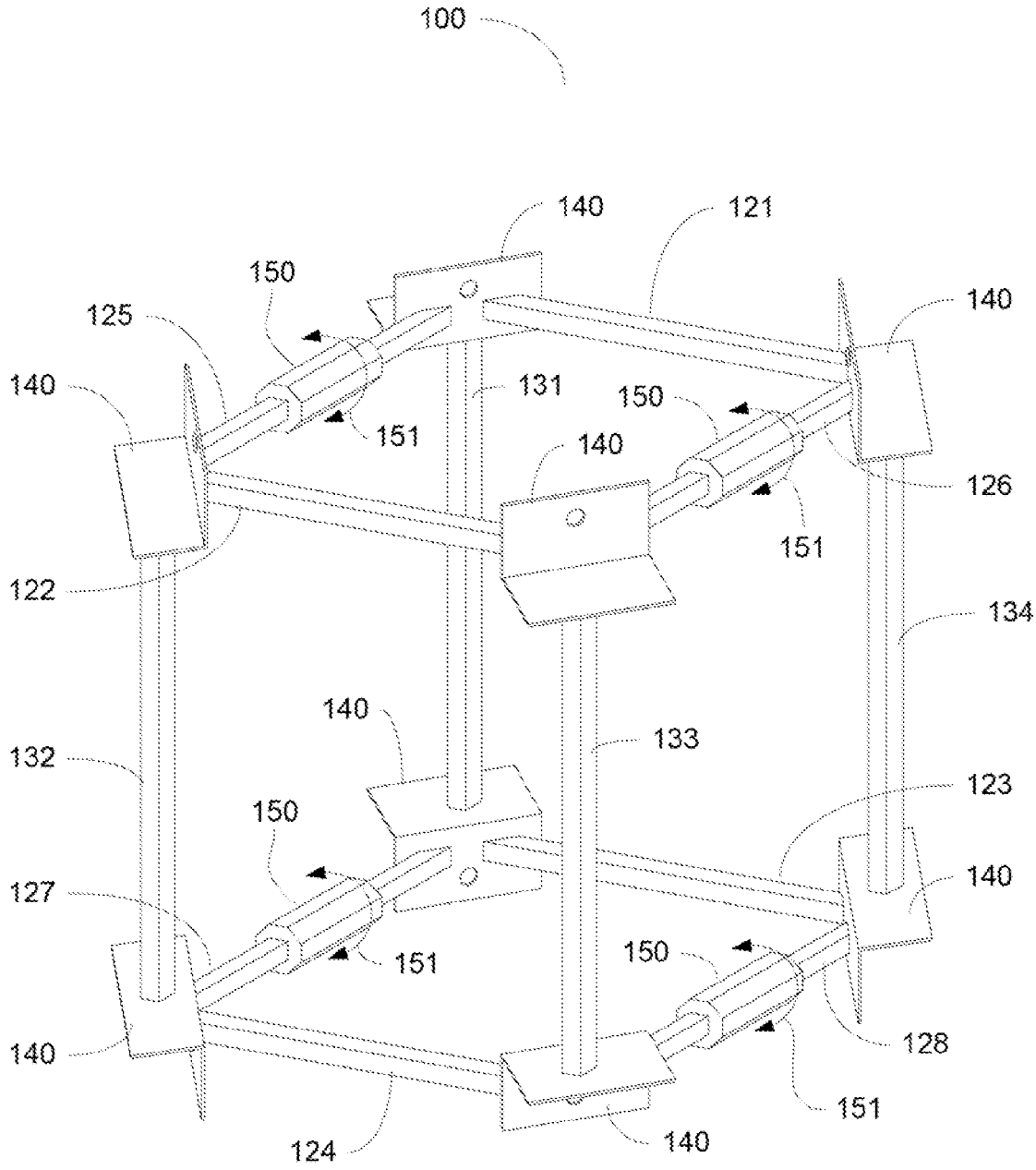
FIG. 4 shows a top perspective view of an alternate embodiment of the keg stacking device, further including adjusting members.

FIG. 4 shows a top perspective view of an alternate embodiment of keg stacking device 100, further including adjusting members 150. In the embodiment shown, adjustment members 150 are positioned on horizontal bars 125, 126, 127, and 128 and allow keg stacking device 100 to be sized to work with different sized kegs (not shown). In the embodiment shown, adjustment members are turnbuckles and made of aluminum. Horizontal bars 125, 126, 127, and 128 threadedly engage adjustment members 150 with reverse threading such that as each adjustment member 150 is rotated (as designated by arrows 151), the total length of each horizontal bar 125, 126, 127, and 128 can be changed. It should be understood, however, that alternate adjustment members 150 could be used or could be made of alternate materials. In addition, adjustment members 150 could also be positioned on horizontal bars 121, 122, 123, and 124 and/or on vertical bars 131, 132, 133, and 134, either instead of or in addition to adjustment members 150 shown on horizontal bars 125, 126, 127, and 128, which would allow keg stacking device 100 to be adjustable in an X, Y, and/or Z direction.

In an alternate embodiment of keg stacking device 100, adjustment members 150 are instead comprised of one (1) portion of horizontal bars 121, 122, 123, 124, 125, 126, 127, 128 and/or vertical bars 131, 132, 133, and 134 are instead formed of two (2) members, a male portion and a female portion, both of which include a series of equally spaced apertures. In such an embodiment, the length of each horizontal bar 121, 122, 123, 124, 125, 126, 127, 128 and/or vertical bars 131, 132, 133, and 134 can be adjusted. The holes allow a pin to be put through both the male and female end to lock horizontal bars 121, 122, 123, 124, 125, 126, 127, 128 and/or vertical bars 131, 132, 133, and 134 at a fixed and adjustable length.

In addition, each embodiment shown in the Figures and described herein is made only of metal. It should be understood that alternate embodiments of keg stacking device 100 can alternatively be coated with rubber (or similar material) or can include pads positioned on some or all of horizontal bars 121, 122, 123, 124, 125, 126, 127, and 128. Such protective members prevent metal-to-metal contact between keg stacking device 100 and the kegs (not shown) which can damage either. In addition, the embodiment of keg stacking device 100 is shown as having a total of twelve (12) bars. It should be understood that additional bars, vertical or horizontal could be included, creating a stronger keg stacking device 100 and/or allowing less robust horizontal bars 121, 122, 123, 124, 125, 126, 127, and 128 and/or vertical bars 131, 132, 133, and 134, herein referred to as additional support members. Other embodiments may contain more, fewer, or differently shaped or configured support members.

While keg stacking device 100 has been shown and described with respect to several embodiments and used in accordance with the present invention, it is to be understood that the same is not limited thereto, but is susceptible to numerous changes and modifications as known to a person of ordinary skill in the art, and it is intended that the present invention not be limited to the details shown and described herein, but rather cover all such changes and modifications obvious to one of ordinary skill in the art.

What is claimed is:

1. A device for stacking a first keg on top of a second keg comprised of:

a plurality of bars, said plurality of bars comprised of a first group of bars, a second group of bars, and a third group of bars, each of said first group of bars being substantially parallel to each other, each of said second group of bars being substantially parallel to each other, each of said third group of bars being substantially parallel to each other, forming a substantially cube-shape;

wherein said plurality of bars allow said first keg to be temporarily positioned on top of said second keg; and a plurality of locking members each comprised of a locking member base having a vertical portion and a horizontal portion, an aperture on said vertical portion, and an adjustable keg engaging member threadingly engaging said aperture to allow lateral movement of said adjustable keg engaging member to engage a neck of one of said first keg or said second keg, each of said plurality of locking members positioned at a meeting point of one of said first group of bars, one of said second group of bars, and one of said third group of bars.

2. The device of claim 1, wherein said first keg and said second keg are each a generally cylindrically-shaped container for storing a liquid, said liquid selected from a group comprised of water, beer, a beverage, a chemical, a paint, and combinations thereof.

3. The device of claim 1, wherein said device is made of a material selected from a group comprised of a metal, resin, carbon fiber, a plastic, a composite, and combinations thereof.

4. The device of claim 1, wherein at least one of said first group of bars and said second group of bars further includes a pad disposed thereon or a rubber coating disposed substantially on said device.

5. The device of claim 1, wherein said device further includes at least one adjustment member to allow a length of at least one of said first group of bars, said second group of bars, and said third group of bars to be adjusted.

6. The device of claim 1, wherein said device further includes at least one additional support member.

7. A cube-shaped device for stacking a first keg on top of a second keg comprised of:

a first group of bars, a second group of bars, and a third group of bars, each of said first group of bars being substantially parallel to each other, each of said second group of bars being substantially parallel to each other, each of said third group of bars being substantially parallel to each other; and a plurality of locking members, each of said plurality of locking members positioned at a meeting point of one of said first group of bars, one of said second group of bars, and one of said third group of bars and comprised of a locking member base having a vertical portion and a horizontal portion, an aperture on said vertical portion, and an adjustable keg engaging member threadingly engaging said aperture to allow lateral movement of said adjustable keg engaging member to engage a neck of one of said first keg or said second keg.

8. The device of claim 7, wherein said first keg and said second keg are each a generally cylindrically-shaped container for storing a liquid, said liquid selected from a group comprised of water, beer, a beverage, a chemical, a paint, and combinations thereof.

9. The device of claim 7, wherein said device is made of a material selected from a group comprised of a metal, resin, carbon fiber, a plastic, a composite, and combinations thereof.

10. The device of claim 7, wherein at least one of said first group of bars and said second group of bars further includes a pad disposed thereon or a rubber coating disposed substantially on said device.

11. The device of claim 7, wherein said device further includes at least one adjustment member to allow a length of at least one of said first group of bars, said second group of bars, and said third group of bars to be adjusted.

12. The device of claim 7, wherein said device further includes at least one additional support member.

13. A device for stacking a first keg on top of a second keg comprised of:

twelve bars, four of said twelve bars forming a first group of bars, four of said twelve bars forming a second group of bars, and four of said twelve bars forming a third group of bars, each of said first group of bars being substantially parallel to each other and perpendicular to each of said second group of bars and said third group of bars, each of said second group of bars being substantially parallel to each other and perpendicular to each of said first group of bars and said third group of bars, and each of said third group of bars being substantially parallel to each other and perpendicular to each of said first group of bars and said second group of bars;

wherein said twelve bars allow said first keg to be temporarily positioned on top of said second keg; and a plurality of locking members each comprised of a locking member base having a vertical portion and a horizontal portion, an aperture on said vertical portion, and an adjustable keg engaging member threadingly engaging said aperture to allow lateral movement of said adjustable keg engaging member to engage a neck of one of said first keg or said second keg, each of said plurality of locking members positioned at a meeting point of one of said first group of bars, one of said second group of bars, and one of said third group of bars.

14. The device of claim 13, wherein said first keg and said second keg are each a generally cylindrically-shaped container for storing a liquid, said liquid selected from a group comprised of water, beer, a beverage, a chemical, a paint, and combinations thereof.

15. The device of claim 13, wherein said device is made of a material selected from a group comprised of a metal, resin, carbon fiber, a plastic, a composite, and combinations thereof.

16. The device of claim 13, wherein at least one of said first group of bars and said second group of bars further includes a pad disposed thereon or a rubber coating disposed substantially on said device.

17. The device of claim 13, wherein said device further includes at least one adjustment member to allow a length of at least one of said first group of bars, said second group of bars, and said third group of bars to be adjusted.

18. The device of claim 13, wherein said device further includes at least one additional support member.

* * * * *